US010926399B2

(12) United States Patent
Mikec

(10) Patent No.: US 10,926,399 B2
(45) Date of Patent: Feb. 23, 2021

(54) DRILL ASSIST DEVICE AND METHOD FOR USE THEREOF

(71) Applicant: Mike Mikec, Canonsburg, PA (US)

(72) Inventor: Mike Mikec, Canonsburg, PA (US)

( * ) Notice: Subject to any disclaimer, the term of this patent is extended or adjusted under 35 U.S.C. 154(b) by 102 days.

(21) Appl. No.: 16/020,985

(22) Filed: Jun. 27, 2018

(65) Prior Publication Data

US 2019/0070722 A1 Mar. 7, 2019

Related U.S. Application Data

(60) Provisional application No. 62/525,786, filed on Jun. 28, 2017.

(51) Int. Cl.

| | |
|---|---|
| ***B25H 1/00*** | (2006.01) |
| ***B25G 1/04*** | (2006.01) |
| *B25G 3/38* | (2006.01) |

(52) U.S. Cl.

CPC ..... *B25H 1/0035* (2013.01); *B25H 1/0078* (2013.01); *B25G 1/04* (2013.01); *B25G 3/38* (2013.01); *B25H 1/0042* (2013.01)

(58) Field of Classification Search

CPC ..... B25H 1/00; B25H 1/0035; B25H 1/0078; B25H 1/0042; B25G 1/04; B25G 3/38; A47C 1/02; B05B 15/62; A47B 9/02; A61H 3/02

USPC ..... 173/184, 31, 39, 45–53, 81, 141, 162.1, 173/213, 168, 170, 171

See application file for complete search history.

(56) References Cited

U.S. PATENT DOCUMENTS

| | | | | |
|---|---|---|---|---|
| 3,985,188 | A * | 10/1976 | Steele | B25C 7/00 173/170 |
| 4,442,905 | A * | 4/1984 | Agoston | B25H 1/0035 173/36 |
| 5,765,821 | A * | 6/1998 | Janisse | B25H 1/0014 269/16 |
| 6,095,724 | A * | 8/2000 | Hurt | B25H 1/0035 408/136 |
| 6,968,989 | B1 * | 11/2005 | Hall, Jr. | B25C 1/02 173/90 |
| 7,228,917 | B2 * | 6/2007 | Davis | B25C 7/00 16/114.1 |
| 7,703,211 | B1 * | 4/2010 | Kirchhoff | A01G 3/08 30/296.1 |
| 7,789,353 | B2 * | 9/2010 | Koerlin | B25H 1/0035 248/122.1 |
| 7,882,847 | B2 * | 2/2011 | Coe | A61H 3/02 135/66 |
| 8,905,687 | B2 * | 12/2014 | Blatz | B25F 5/021 408/1 R |
| 9,044,836 | B2 * | 6/2015 | Blatz | B23Q 9/00 |

(Continued)

*Primary Examiner* — Gloria R Weeks

(57) ABSTRACT

A drill assist device comprising a first segment and a second segment telescopically coupled to one another, where the first segment further contains a gas strut. A pull down handle is configured to connect the first segment and the second segment and enable compression of the drill assist device when a worker applies pressure to the pull down handle. This compression is further assisted by at least one wire rope cable that is affixed to both the pull down handle and the second segment and may be secured via one or more wire rope clamps. The wire rope claims maybe tightened or released to extend or retract the second segment to achieve the desired height of the drill assist device.

10 Claims, 6 Drawing Sheets

(56) References Cited

U.S. PATENT DOCUMENTS

| | | | | |
|---|---|---|---|---|
| 9,174,337 | B2 * | 11/2015 | Buchner | B25H 1/0035 |
| 9,434,008 | B2 * | 9/2016 | Vuckovic | B25H 1/0021 |
| 9,878,439 | B2 * | 1/2018 | May | B25H 1/0035 |
| 10,730,174 | B2 * | 8/2020 | Felton | B25D 17/30 |
| 2005/0214085 | A1 * | 9/2005 | Owens | B25H 1/0057 408/136 |
| 2008/0202264 | A1 * | 8/2008 | Howland | B25F 5/00 74/156 |
| 2016/0263738 | A1 * | 9/2016 | May | B25H 1/0035 |
| 2016/0318171 | A1 * | 11/2016 | Gonzales | B25G 1/04 |
| 2017/0157727 | A1 * | 6/2017 | Felton | B23Q 11/0071 |
| 2017/0225320 | A1 * | 8/2017 | Swift | F16M 11/28 |

* cited by examiner

DRILL ASSIST DEVICE AND METHOD FOR USE THEREOF

RELATED APPLICATIONS

This Application claims the benefit, under 35 USC § 119(e), of the prior-filed and U.S. Provisional Patent Application No. 62/525,786, filed on Jun. 28, 2017, entitled "Drill Assist Tool and Method for Use Thereof," which is hereby incorporated by reference in its entirety.

BACKGROUND

Current methods for overhead drilling require the use of heavy, cumbersome machinery that is held in place during use by one or more workers. Such use puts substantial stress and strain on the workers operating the devices and results in workers becoming physically sore, greatly fatigued, or even injured after just a few hours of work. This approach is also slow, inefficient, and results in inaccurate and imprecise results due to the burden of lifting and holding heavy equipment for prolonged periods of time. Workers must also position themselves in close proximity to the targeted drilling surface. In cases of overhead drilling, this means that a worker's face will need to be very close to the drilling surface, creating significant risk of eye and other injuries due to flying dust and debris which is a byproduct of drilling any surface.

There exists a need for a drill assist tool that can overcome the limitations of the prior art. In particular, it would be advantageous if a device was configured to assist a worker during various construction operations, including overhead drilling that reduces the risk associated with the current methods and also improves efficiency and productivity.

SUMMARY OF THE INVENTION

The present disclosure provides for a drill assist device that overcomes the limitations of the prior art by (1) reducing stress, strain, and fatigue on workers operating construction machinery and tools, such as drills; (2) reducing the risk of eye and other injury due to proximity to a drilling surface and flying debris; (3) increasing the efficiency and productivity of workers; and (4) improving the accuracy and reliability of the work performed. In particular, the drill assist device described herein holds potential for use in overhead drilling applications where the afore mentioned risks are exceptionally high.

A drill assist device may comprise a first segment and a second segment, wherein the first segment and the second segment are telescopically coupled. A pull down handle may be configured to receive both the first segment and the second segment via a coupling mechanism. At least one wire rope cable may be affixed to both the pull down handle and the second segment. The wire rope cable may be configured to enable the second segment to compress upon a worker's application of pressure to the pull down handle. A tool rest designed to receive a tool or construction materials may then be affixed to the second segment.

The drill assist device of the present disclosure is advantageous over current tool assist devices because it relies on manual operation and does not require the use of pneumatic, fluid, air, electric, or other similar mechanisms for operation. The drill assist device described herein is also configured in an easily movable, compact, and lightweight manner and may be easily adjusted to achieve the desired height without ratcheting or other similar mechanisms. Such a design eliminates the need for complicated and cumbersome mounting or rigging of the device for operation and for easy storage and transportability between construction sites. Such a design also enables customizability of the device to ensure comfortable operation by individual workers during use.

BRIEF DESCRIPTION OF THE DRAWINGS

The accompanying drawings, which are included to provide further understanding of the disclosure and are incorporated in and constitute a part of this specification, illustrate embodiments of the disclosure and, together with the description, serve to explain the principles of the disclosure.

In the drawings.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
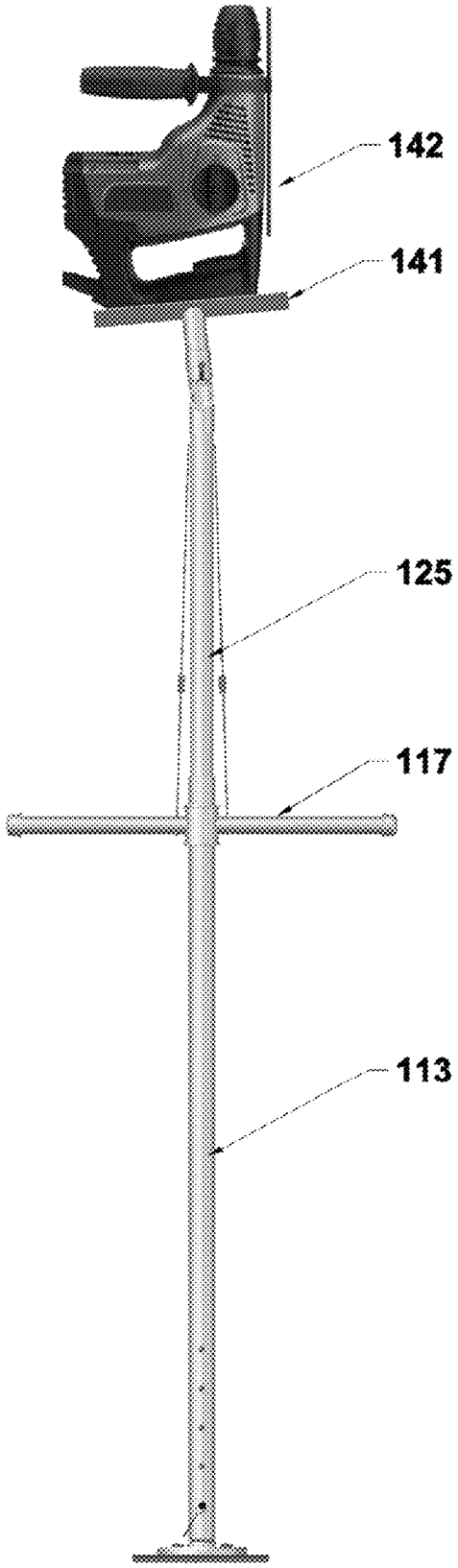
FIG. 1 is representative of a tool of the present disclosure.

FIG. 1 illustrates the intended use of the drill assist device 100 at a high level. As can be seen from FIG. 1, the drill assist device 100 may comprise multiple pieces/segments arranged in an operable assembly and is designed to receive a drill or other similar tool. The drill illustrated in FIG. 1 is a hammer drill 142, but the present disclosure should not be limited to assisting with only the use of this specific drill and should be interpreted broadly to assist workers as they use other similar tools.

The drill assist device 100 may be configured so that a tool is placed in a tool rest 141 and held in place by a worker wrapping their hand around the tool rest 141 and the tool's trigger or handle. In another embodiment, the drill assist device 100 may be further configured with a strap or other mechanism for securing the tool rest 141 of the drill assist device 100 to avoid the need for the worker to manually hold the drill in place.

To use the drill assist device 100, a worker may first insert a drill onto the tool rest 141 with the drill 142 rotated so as to be oriented in a non-vertical position with respect to the side of the drill assist device 100. The worker wraps one hand around tool or material rest 141 and drill trigger/handle and the worker's second hand on the drill's t-handle. The worker then pulls down on the drill 142 and the drill assist device until the drill can be rotated vertically to position the drill bit on desired drilling target.

In another embodiment, the drill assist device 100 may be operated by more than one worker, for example as a two-person team. Here, the drill 142 may be rotated so as to be orientated in a non-vertical position with respect to the side of the drill assist device 100 with a first worker's one hand wrapped around the tool rest 141 and the tool's trigger or handle and the first worker's second hand on the tool's t-handle or similar mechanism. A second worker may press down evenly with both hands on the pull down handle 117 of the drill assist device 100 until the drill 142 can be rotated vertically to position the drill bit, or other similar feature, on the desired surface target such as a drilling location. By holding down pressure on only one side of the pull down handle 117 holds potential for enabling a worker to easily hold the tool compressed. By letting off the handle 117, the drill assist device extends, applying approximately seventy (70) pounds of steady and constant force to the tool for use such as drilling. This steady and constant force also holds potential for prolonging the life of drill bits and other similar component parts.

Referring now to FIG. 2-5, which illustrates the features of the drill assist device 100 in more detail, a base plate 101, which may comprise aluminum or other similar material known in the art, 101 may serve as a means for mounting the drill assist device 100 and providing a support that can be used to rest the drill assist device 100 on the ground or other surface during operation or while in storage. A rubber pad 105 may be used to further secure the drill assist device 100 on the surface, to prevent slippage of the drill assist device 100, and to protect the underlying surface from damage, scratches, or other wear.

A pipe flange 107 may be connected to the base plate 101 via one or more screws 103. In one embodiment, the screws 103 may comprise hex head machine screws or other similar fastening mechanism known in the art. The pipe flange 107 may be further configured to receive a first segment 113 of the drill assist device 100 which comprises an internal gas strut 111(*b*) (see FIG. 4). In one embodiment, the first segment 113, as well as other segments that comprise the drill assist device 100 may comprise galvanized rigid conduit, aluminum, or other similar material known in the art.

This first segment 113 is may be affixed to the pipe flange 107 via threads on bottom of first segment 113 but could be welded with further development of the tool. The first segment 113 may further be comprised of one or more sets of holes 111(*a*) that are configured for adjusting the height of the drill assist device 100 via the internal gas strut 111(*b*) anchoring point via holes 111*a* and a locking pin 109.

This first segment 113 may be further coupled to a second segment 125. The second segment 125 also comprises the internal gas strut 111(*b*) that can be adjusted for the height of the individual worker using it. The second segment 125 may further be designed so that it has a diameter that is smaller than the first segment 113 so that the segments may be telescopically connected.

A threaded coupling 115 slips over the first segment 113 and is configured to form a pull down handle 117. In one embodiment, the pull down handle 117 may further comprise one or more end caps 117(*a*) and 117(*b*). As with the various segments of the drill assist device 100, a pull down handle 117 may comprise galvanized rigid conduit, aluminum, or other similar material known in the art.

The pull down handle 117 may be operably coupled to second segment 125 via one or more wire rope cables 123, which are affixed to a pull down handle 117 by threading the wire rope cables 123 through a second set of one or more holes 119. The wire rope cables 123 are configured to enable the drill assist device 100 to compress upon a worker's application of force by connecting to the upper portion of the second segment 125 via a third set of one or more holes 127. The wire rope cables 123 may be further secured using one or more wire rope clamps 121 which, in one embodiment, may also be configured to adjust to the pull down handle 117 operating height.

A first coupling means 129 may be configured to connect the second segment 125 to a tool rest insert sleeve 131. This tool rest insert sleeve 131 may comprise a tool rest adjustment screw 133, which may comprise a tee screw or other similar mechanism know in the art, that may be configured so as to adjust the angle and/or orientation of the tool rest insert sleeve 131.

A second coupling means 137 may be configured to connect the tool rest insert sleeve 131 with a tool or material rest 141 via a connector segment 139. This connector segment 139 may be further welded or otherwise affixed to the bottom end of the tool or material rest 141. As described above in connection with FIG. 1, this tool or material rest 141 may be configured to receive one or more tools or materials.

This tool or material rest 141 may be designed so that a worker can easily rest a drill or other tool or material that is being used during a construction job. In one embodiment, this material rest 141 may be designed in a flexible manner so that it can be rotated or tilted at various angles as needed to drill on uneven/curved surfaces. Current designs for drill assist tools are limited in the sense that they cannot be easily configured for use on surfaces that are not flat. For example, some current designs require mounting the drill assist tool to another surface or other object. Others provide for such a ridged coupling between the drill and the assist tool that the drill cannot be maneuvered as needed.

To use the drill assist device 100, a worker can pull down on the material rest 141 to compress the first segment 113 and the second segment 125 (comprising the internal gas strut) together. The gas strut 111(*b*) forces these pieces of tool back apart and makes the drill, or other tool being used, go into the surface that is being drilled.

Figure 2:
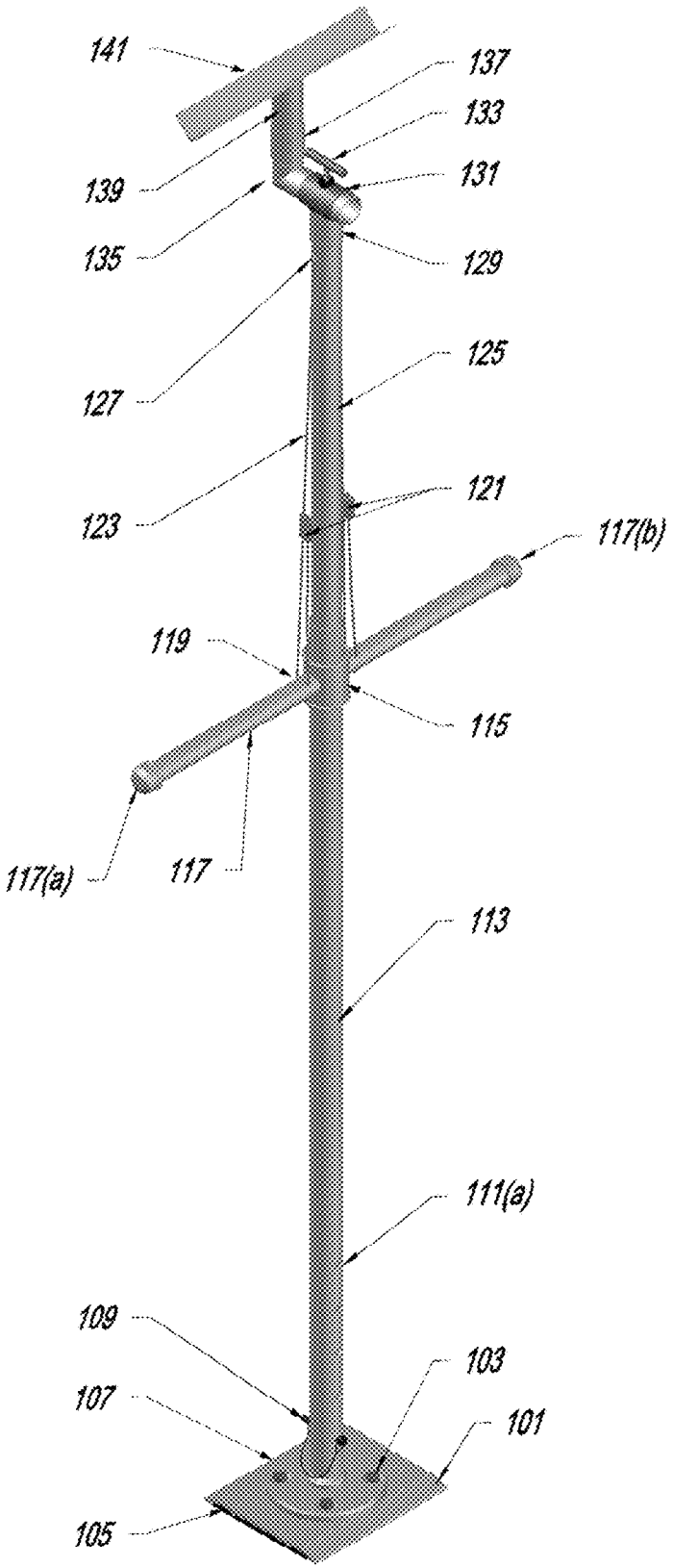
FIG. 2 is representative of a isometric view of a tool of the present disclosure.
Figure 3A:
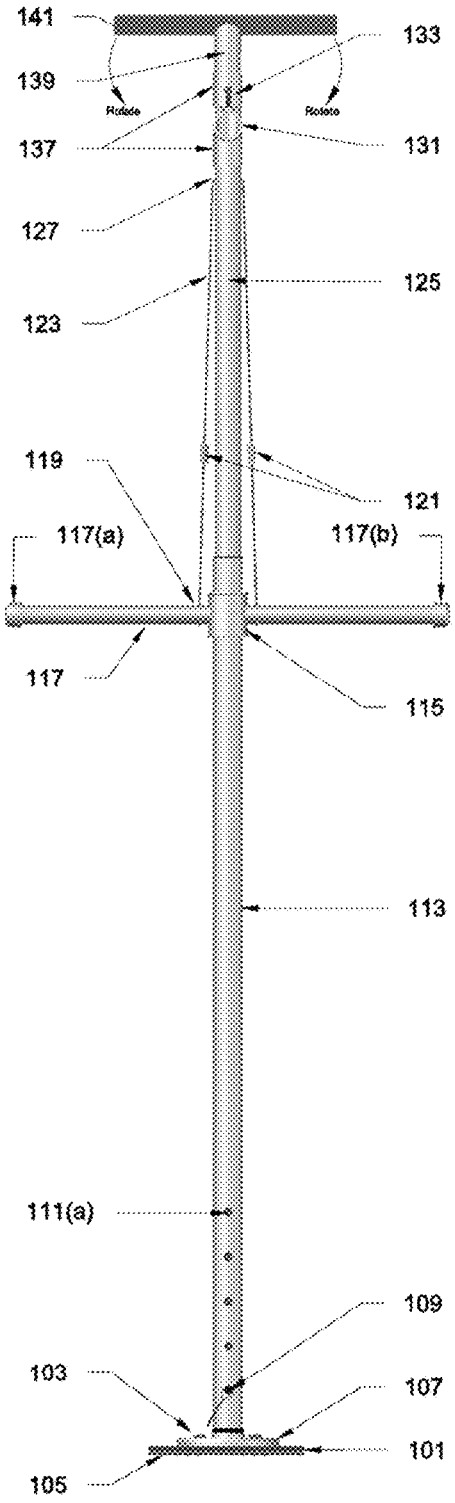
FIG. 3*a* and FIG. 3*b* is representative of a front and isometric view of a tool of the present disclosure.
Figure 3B:
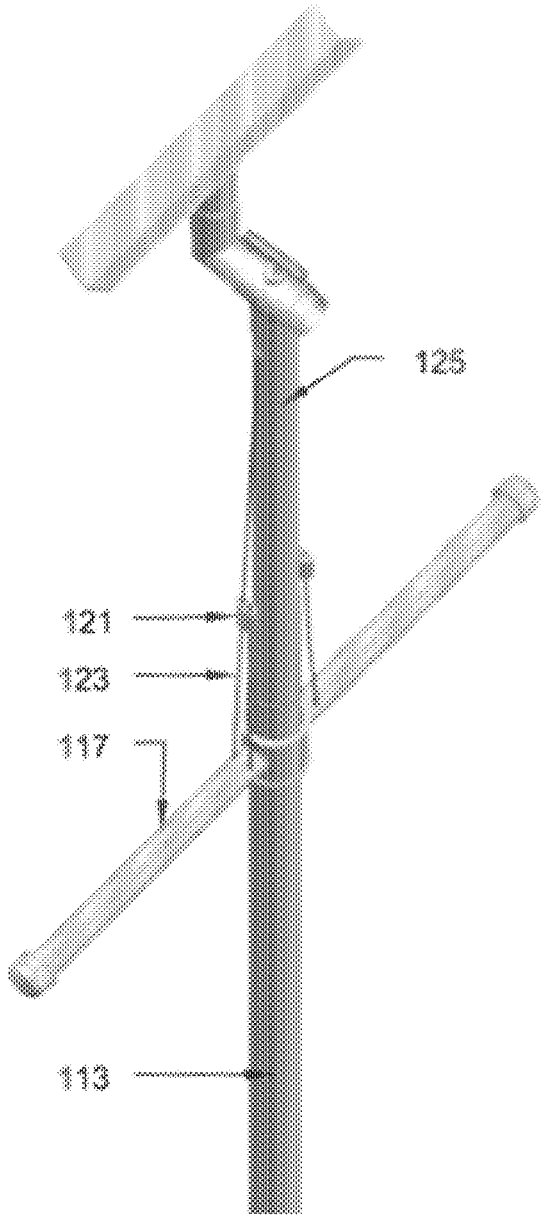

FIG. 3*a* and FIG. 3*b* are representative of a front and isometric view of a drill assist device 100 of the present disclosure. In addition to the features described in connection with the description of FIG. 2, FIG. 3*a* and FIG. 3*b* provide additional detail regarding an embodiment where two (2) wire rope cables 121 are used to couple the pull down handle 117 to the second segment 125.

Figure 4:
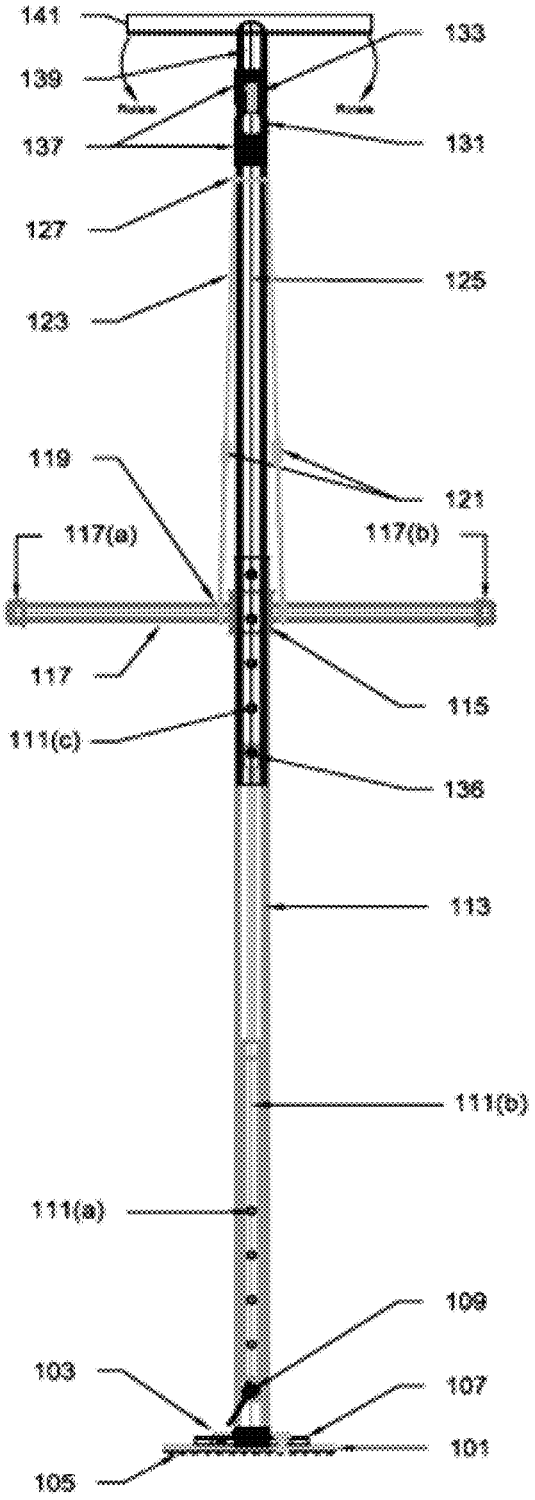
FIG. 4 is representative of a front section view of a tool of the present disclosure which illustrates the internal operations of the tool.
Figure 5:
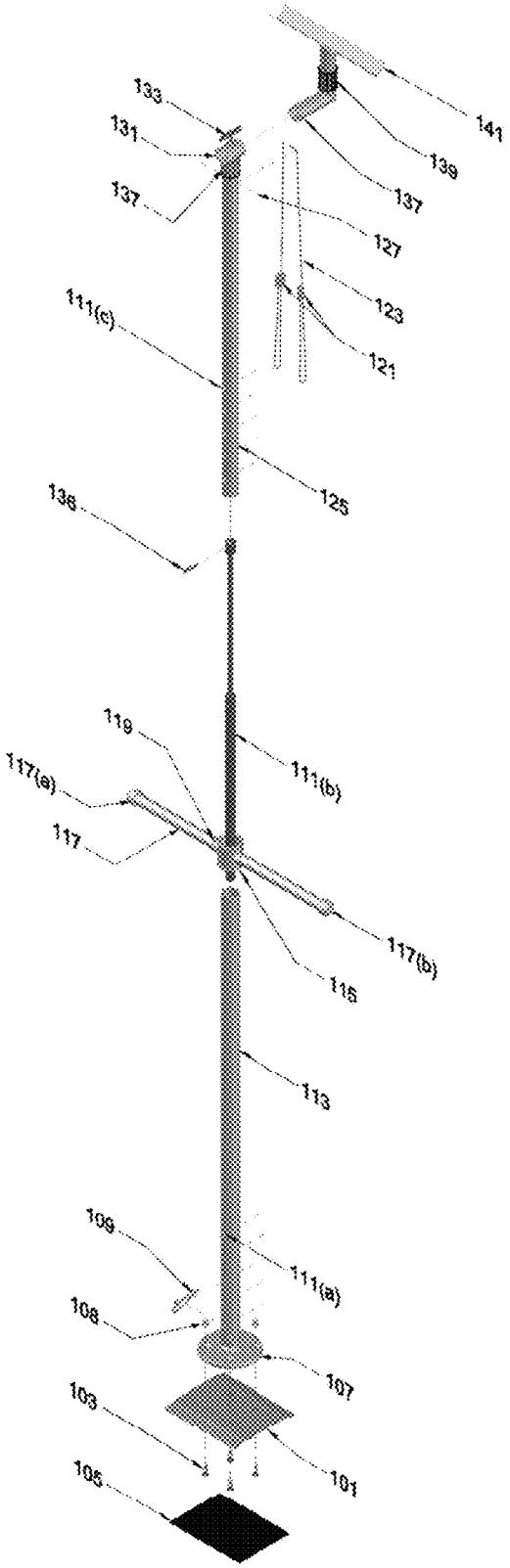
FIG. 5 is representative of a exploded isometric view of a tool of the present disclosure which illustrates an exploded view of component parts.

FIG. 4 and FIG. 5 provide additional views of the drill assist device 100. In FIG. 4, the internal mechanisms and attachment locations of the gas strut 111*b* can be seen. In particular, the gas strut 111(*b*) bottom attachment point 111*a* via locking pin 109 and the gas strut top attachment points 111(*c*) via 136 are illustrated as operably coupled to the various connection points of the drill assist device 100.

FIG. 5 is representative of an exploded view of a drill assist device 100 of the present disclosure. In addition to the features described in connection with the review of FIG. 1-FIG. 4, FIG. 5 further illustrates how all the component parts of the drill assist device 100 fit together.

Example

The drill assist tool described herein overcomes the limitations of the prior art by providing for an ergonomic design that decreases the stress, strain, and fatigue experienced by users of unassisted tools or the drill assists described in the prior art. In one example, the drill assist tool was used by various workers in connection with a tunnel construction project. The project required approximately one (1) mile of conduit and approximately one thousand (1,000) associated anchors to be installed on the middle of the tunnel ceiling. The conduit was to be supported using two ½" stainless steel undercut anchors. These ½" anchors required a ⅞" diameter×8" deep hole for each to be drill in the existing ceiling of the tunnel. In addition to drilling a hole for each anchor, each hole required reaming of the last 1" of the hole. The reaming was accomplished by means of a tool that was provided from the anchor manufacture that was inserted into the ⅞"×8" deep hole. With steady pressure on the tool this forces two blades outward into the sides of the hole cutting away concrete providing a conical shape relief in which the anchor expands into. In particular, a hole is first drilled to the appropriate depth and diameter using a hammer bit or diamond core bit. The hole is then cleaned using a mechanism known in the art such as a blow-out bulb, compressed air, or a hand brush. Once the hole has been cleaned, an undercutting tool bit may be inserted to start the drill, in rotary mode only, with an indicator pin at the top of the slot. Drilling may continue with steady pressure until the indicator pin is at the bottom of the slot. Next, a nut and washer is removed from the maxi-bolt and the maxi-bolt is screwed into a hand bolt setter until the maxi-bolt sleeve is flush with the bottom of the setter. The top nut is turned until the indicator pin is at the top of the slot and then the setter may be removed. Lastly, the appropriate torque may be applied with the attachment in place.

For purposes of this Example, the hammer drill used was a Hilti TE-40 which weighs roughly thirteen (13) pounds and all drilling and associated activities were to be performed overhead. This was incredibly taxing on the workers performing the task, with workers complaining of sore shoulders after only one (1) night of work.

During the first few nights of work, workers only averaged around twenty (20) anchors a night, with about five (5) hours of work performed, which was consistent with past projects of a similar nature. To increase productivity, efficiency, and to ease the stress and strain felt by the workers, the drill assist device of the present disclosure was implemented. With the drill assist device, workers drilled a ⅞" hole to the depth of 8" in less than two minutes with little effort. Over the course of the same five (5) hour work shift, workers increased the amount of holes drilled from approximately twenty (20) holes a night, using per two man crew, to over seventy (70) holes a night.

In addition to increased productivity and efficiency with respect to the amount of work that could be performed in a given five (5) hour work shift, the workers themselves experienced significant benefits by using the drill assist device. The workers no longer complained of stress or strain on the neck, back, or shoulders due to the ergonomic design of the drill assist device and due to the amount of weight the drill assist device can take off of the workers.

Additional benefits over an unassisted use of a drill, or an assist as described in the prior art, was that while performing the drilling task the worker does not have to position themselves directly beneath the drill providing a significantly more distance from the dust and possible flying debris that is a byproduct of drilling work and which presents risk in terms of injury to eyes, face, or other parts of the worker's body.

Operation of the drill assist device was performed as described herein above. First, the worker adjusted the drill assist device height to the appropriate height of the individual worker using the drill assist device. The top of the drill assist device is the tool or material rest which may be positioned roughly twelve to sixteen inches above a worker's shoulder. To adjust the height of the drill assist device a ¼"×2" lock pin located at the bottom of the drill assist device was removed. The second segment of the drill assist device may be extended or retracted until the lock pin re-aligns with the internal gas strut hole and re-install the lock pin. If a pull down hand was to be used, a worker may re-adjust handle height by releasing the wire rope clamps and lengthen or shorten the wire rope length.

Wire rope clamps may be positioned with wire rope cable ends just protruding through the wire rope clamps. It is advantageous to avoid excessive wire rope cable end lengths passed through the wire rope clamps to avoid possible injuries to workers such as abrasions or cuts.

For purposes of this Example, the drill assist device was intended to be used for drilling of a hole in a conventional manner. The worker(s) performing this task will most likely be standing on a scissor lift or scaffolding. The height of the drilling platform may therefore be set so that the surface being drilled would be approximately 30" above the head of the worker performing the drilling. The drill assist device may be arranged vertically beneath the desired location in which the hole is to be installed.

The present disclosure may be embodied in other specific forms without departing from the spirit or essential attributes of the disclosure. Accordingly, reference should be made to the appended claims, rather than the foregoing specification, as indicating the scope of the disclosure. Although the foregoing description is directed to the embodiments of the disclosure, it is noted that other variations and modification will be apparent to those skilled in the art, and may be made without departing from the spirit or scope of the disclosure.

What is claimed is:

1. A drill assist device comprising:

a first segment and a second segment, wherein the first segment and the second segment are telescopically coupled and wherein the second segment further comprises an internal gas strut;

a pull down handle comprising a first coupling mechanism wherein the coupling mechanism is configured to receive both the first segment and the second segment;

at least one wire rope cable, wherein the wire rope cable is affixed to both the pull down handle and the second segment and wherein the wire rope cable is configured so as to enable the second segment to compress upon the application of pressure to the pull down handle; and a tool rest affixed to the second segment, wherein the tool rest is further configured so as to receive a tool, wherein the compression of the first segment and the second segment causes the internal gas strut of the second segment to force apart the first segment and the second segment and actuate the drill.

2. The drill assist device of claim 1 wherein at least one of the first segment, the second segment, and the pull down handle further comprise galvanized rigid conduit.

3. The drill assist device of claim 1 a further comprising one or more wire rope clamps affixed to the second segment and configured so as to lock or release the second segment in one or more positions so as to compress or expand.

4. The drill assist device of claim 1 further comprising:

a base plate; and a pipe flange, wherein the pipe flange is further configured to receive one end of the first segment and secure the first segment to the base plate.

5. The drill assist device of claim 4 further comprising a rubber pad, wherein the rubber pad is affixed to the base plate.

6. The drill assist device of claim 1 wherein the pull down handle further comprises one or more end caps.

7. The drill assist device of claim 1 wherein the tool rest is further affixed to the second segment via a second coupling mechanism, wherein the second coupling mechanism is configured so as to receive the second segment and the tool rest.

8. The drill assist device of claim 7 wherein the second coupling mechanism further comprises an adjustment screw that is configured so as to adjust the position of the tool rest.

9. The drill assist device of claim 1 further comprising a gas strut located inside of the first segment.

10. The drill assist of claim 1 wherein actuating the drill further comprises inserting the drill into a surface to be drilled.

* * * * *